US009211736B2

(12) United States Patent
Fletcher et al.

(10) Patent No.: US 9,211,736 B2
(45) Date of Patent: Dec. 15, 2015

(54) SYSTEM AND METHOD FOR REDUCING ELECTROSTATIC FIELDS UNDERNEATH PRINT HEADS IN AN ELECTROSTATIC MEDIA TRANSPORT

(75) Inventors: Gerald M. Fletcher, Pittsford, NY (US); Joannes N. M. de Jong, Hopewell Junction, NY (US); Peter Knausdorf, Henrietta, NY (US); Steven R. Moore, Pittsford, NY (US); Palghat S. Ramesh, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 160 days.

(21) Appl. No.: 13/557,784

(22) Filed: Jul. 25, 2012

(65) Prior Publication Data

US 2014/0028769 A1 Jan. 30, 2014

(51) Int. Cl.

| | |
|---|---|
| ***B41J 2/01*** | (2006.01) |
| ***B41J 11/06*** | (2006.01) |
| *B41J 2/045* | (2006.01) |
| *B41J 11/00* | (2006.01) |

(52) U.S. Cl.

CPC ..... *B41J 11/06* (2013.01); *B41J 2/04511* (2013.01); *B41J 11/007* (2013.01)

(58) Field of Classification Search

CPC ..... B41J 11/007; B41J 13/08; B41J 15/048; B41J 11/02; B41J 11/06; B41J 3/28; B41J 2/08; B41J 2/085; B41J 2/095; B41J 2/41; B65G 15/00

USPC ..... 347/104, 101, 16, 76, 79, 112

See application file for complete search history.

(56) References Cited

U.S. PATENT DOCUMENTS

| | | | | |
|---|---|---|---|---|
| 3,760,229 | A | 9/1973 | Silverberg | |
| 3,881,818 | A * | 5/1975 | McFarlane et al. | 430/53 |
| 3,966,199 | A | 6/1976 | Silverberg | |
| 5,593,151 | A | 1/1997 | Mashtare et al. | |
| 5,839,024 | A | 11/1998 | May et al. | |
| 6,203,141 | B1 * | 3/2001 | Wakahara et al. | 347/55 |
| 6,508,540 | B1 * | 1/2003 | Lean et al. | 347/55 |
| 6,817,692 | B2 * | 11/2004 | Nakazawa et al. | 347/12 |
| 7,216,968 | B2 * | 5/2007 | Smith et al. | 347/102 |
| 7,712,892 | B2 * | 5/2010 | Nishida et al. | 347/104 |
| 7,731,186 | B2 * | 6/2010 | Krause et al. | 271/193 |
| 7,957,656 | B2 | 6/2011 | Moore et al. | |
| 8,142,010 | B2 * | 3/2012 | Ageishi | 347/104 |
| 2001/0028380 | A1 * | 10/2001 | Wotton et al. | 347/102 |

(Continued)

OTHER PUBLICATIONS

Zamankhan et al., "Effects of Corotron Size and Parameters on the Dielectric Substrate Surface Charge", Journal of Electrostatics, vol. 65, pp. 709-720; 2007.

*Primary Examiner* — Julian Huffman
*Assistant Examiner* — Leonard S Liang
(74) *Attorney, Agent, or Firm* — Hoffmann & Baron, LLP

(57) ABSTRACT

Embodiments described herein are directed to a system for reducing electrostatic fields underneath print heads in a direct marking printing system. The system includes: one or more print heads for depositing ink onto a media substrate; a media transport for moving the media substrate along a media path past the one or more print heads; a conductive platen contacting the media transport belt; and an electrostatic field reducer that includes an alternating current corona device positioned upstream of the one or more print heads. The media transport includes a media transport belt and, when the media substrate is on the transport belt it has an electrostatic field, which can cause printing defects. The electrostatic field reducer reduces the electrostatic field on the surface of the media substrate and thereby reduces printing defects.

13 Claims, 5 Drawing Sheets

(56) References Cited

U.S. PATENT DOCUMENTS

2002/0067401 A1* 6/2002 Yraceburu et al. ..... 347/102
2006/0055734 A1* 3/2006 Kadomatsu et al. ..... 347/55
2006/0077232 A1* 4/2006 Nakazawa ..... 347/55
2006/0109325 A1* 5/2006 Araya et al. ..... 347/101
2007/0046764 A1* 3/2007 Nakazawa ..... 347/224
2008/0284823 A1* 11/2008 Moriyama et al. ..... 347/55
2010/0079569 A1* 4/2010 Kumagai et al. ..... 347/102
2013/0027491 A1* 1/2013 Koike et al. ..... 347/104

* cited by examiner

SYSTEM AND METHOD FOR REDUCING ELECTROSTATIC FIELDS UNDERNEATH PRINT HEADS IN AN ELECTROSTATIC MEDIA TRANSPORT

BACKGROUND

1. Technical Field

The presently disclosed technologies are directed to a system and method for reducing the magnitude of the electrostatic field as a printing media substrate travels underneath a solid ink print head. The system and method described herein use an alternating current corona device to reduce the magnitude of the electrostatic field on a printing media substrate and decrease potential print quality defects.

2. Brief Discussion of Related Art

In order to ensure good print quality in direct to paper ("DTP") ink jet printing systems, the media substrate must be held extremely flat in the print zone. Some proposed methods for achieving this use electrostatic tacking of the media substrate to a moving transport belt that is held flat against a conductive platen in the imaging zones. An undesirable side effect of electrostatic tacking of media substrates is the creation of a high electric field between the surface of the media substrate and the imaging heads (also referred to herein as print heads). As the media substrate travels in the printing zone, the high electrostatic field can affect the ink jetting, which results in print quality defects.

FIG. 1 depicts an exemplary prior art printing system. The media substrate (MS) is transported onto the hold-down transport using a traditional nip based registration transport with nip releases. As soon as the lead edge of the media substrate is acquired by the hold-down transport, the registration nips are released. A vacuum belt transport is used to acquire the media substrate (MS) for the print zone transport (PZT).

FIG. 2 depicts an alternate prior art method for media substrate acquisition wherein electrostatic forces are used to tack the media substrate (MS), e.g., paper, onto a transport belt (TB). The figure shows an exemplary media tacking method which is well known in the state of the art. The transport belt (TB) can be fabricated from relatively insulating (i.e., volume resistivity typically greater than $10^{12}$ ohm-cm) material. Alternatively, the transport belt (TB) can include layers of semi-conductive material if the topmost layer is made from relatively insulating material. If semi-conductive layers are included in the transport belt, the quantity "volume resistivity in the lateral or cross direction divided by the thickness of the layer" or "sheet resistance" is typically above $10^{10}$ ohms/square for any such included layers. The basic belt transport system includes a drive roll (D), tensioning roll (T) and steering roll (S). The transport belt material may be an insulator or a semiconductor. The basic media tacking is shown in the dashed box upstream of the print heads (PH). Two rolls (1 & 2) are used. Roll 1 is on top of the belt/media substrate and roll 2 is below the belt. A high voltage is supplied across roll 1 and roll 2 to produce tacking charges. Either roll 1 or roll 2 may be grounded. An optional blade (shown upstream of the rollers) can be used to enhance tacking by forcing the paper against the roll.

The media substrate, when tacked by electrostatic tacking methods, almost always produces an electric field. When the media substrate travels through the print zone, the high electric field resulting from the electrostatic tacking can interact with the ink ejection. This can frequently produce print quality defects. Accordingly, it is desirable to reduce the magnitude of the electric field when the media substrate passes the print heads in order to mitigate or eliminate print quality defects.

SUMMARY

According to aspects described herein, there is disclosed a system for reducing electrostatic fields underneath print heads in a direct marking printing system. The system includes: one or more print heads for depositing ink onto a media substrate in one or more ink ejection areas; a media transport for moving the media substrate along a media path in a process direction past the one or more print heads; a conductive platen contacting the media transport belt; and an electrostatic field reducer that includes an alternating current corona device positioned upstream of the one or more print heads in the process direction. The media transport includes a media transport belt. An electrostatic field secures the media substrate to the transport belt. The conductive platen has a plurality of non-conductive elements corresponding to the locations of the one or more ink deposition areas of the one or more print heads and is preferably substantially flat. The plurality of non-conductive elements extends in the process direction and in a trans-process direction. The electrostatic field reducer reduces the electrostatic field to less than 0.2 V/micron on a surface of the media substrate receiving the ink.

The plurality of non-conductive elements in the conductive platen is preferably formed by a plurality of apertures; however, the non-conductive elements can also be formed by areas of non-conductive material, such as a plastic, ceramic or glass. The plurality of apertures can have a width in the process direction and a length in the trans-process direction, wherein the length is greater than the width. The apertures have a dimension in the process direction that is at least 180% of the process dimension of the ink ejecting region of the print head, when the print head has an 11 mm array and, preferably, at least 9 mm greater than the process dimension of the ink ejecting region of the print head. Most preferably, the apertures have a dimension in the process direction of at least 20 mm, preferably 25 mm and most preferably 30 mm. The media transport belt is formed from insulative or semi-conductive materials and is preferably constructed in layers. The semi-conductive materials in the layers preferably have a sheet surface resistivity greater than $10^{10}$ ohms/sq., wherein the sheet surface resistivity is defined as the volume resistivity in the surface direction divided by the layer thickness.

The alternating current corona device is a charge generating device that emits an electrostatic charge to a predetermined location. The charge can have an AC voltage in a range of from 2-10 kV at 200 to 1000 Hz. Preferably, the AC voltage is about 5 kV at about 600 Hz. The location of the discharge of the alternating current corona device on the surface of the media substrate is at least 25 mm from any conductive surface below the belt. This avoids problems caused by grounding. The system can also include an electrostatic charge generator located upstream of the electrostatic field reducer for generating electrostatic charges on the surface of the media substrate. The electrostatic charges form the electrostatic field and the media substrate is held against the media transport belt by the electrostatic field. The electrostatic field reducer reduces the electrostatic field to less than 0.2 V/micron on the surface of the media receiving the ink. Preferably, the electrostatic field reducer reduces the electrostatic field on the surface of the media receiving the ink to about zero.

According to other aspects described herein, there is provided a method for reducing electrostatic fields underneath print heads in a direct marking printing system. The method includes: providing a printing system having one or more print heads for depositing ink onto a media substrate in one or more ink deposition areas, a media transport having a media transport belt for moving the media substrate along a media path in a process direction past the one or more print heads, and a conductive platen contacting the media transport belt; generating electrostatic charges to form an electrostatic field that tacks a media substrate to the media transport belt; subjecting the media substrate to the discharge from an alternating current corona device to reduce the electrostatic field; passing the media substrate tacked to the media transport belt underneath the print heads; and depositing ink onto the surface of the media substrate from the print heads. The method improves the quality of the printing by reducing defects caused by the electrostatic field on the surface of the media substrate.

The conductive platen has a plurality of non-conductive elements located in registration with the one or more ink ejection areas, which extends in the process direction and in a trans-process direction. The non-conductive elements have a width in the process direction and a length in the trans-process direction, wherein the length is greater than the width. The non-conductive elements are preferably apertures. The media transport belt can include one or more layers of semi-conductive materials having a sheet resistivity greater than $10^{10}$ ohms/sq.

DETAILED DESCRIPTION

Figure 1:
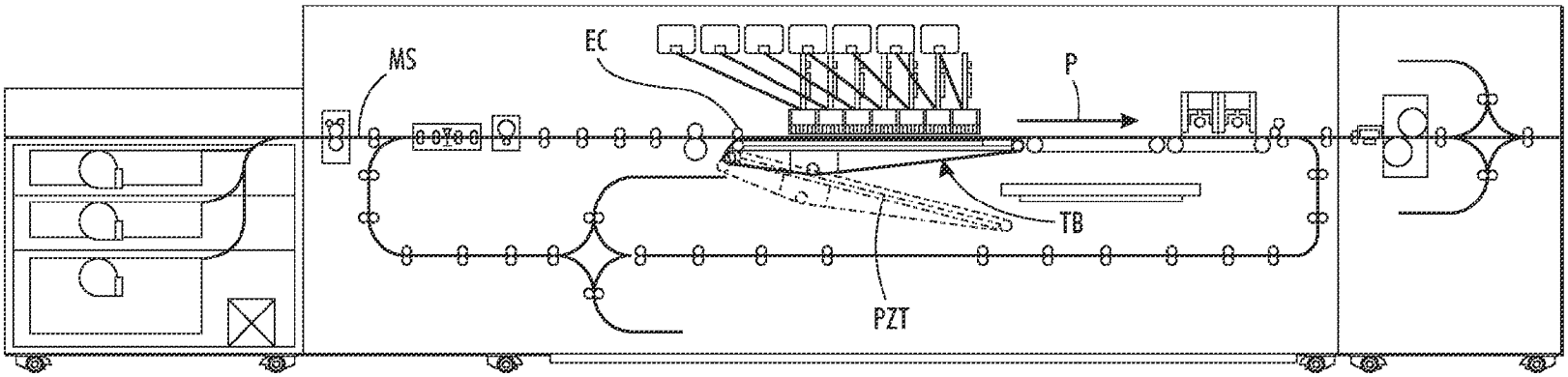
FIG. 1 PRIOR ART
FIG. 1 depicts a prior art ink jet printing system that uses nip based registration transport to transport a media substrate past the print heads.
Figure 2:
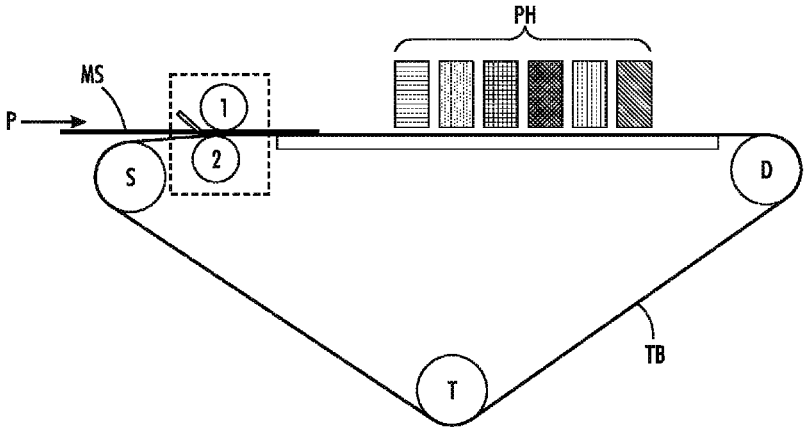
FIG. 2 PRIOR ART
FIG. 2 depicts a prior art ink jet printing system that uses electrostatic tacking to transport a media substrate past the print heads.

The exemplary embodiments are now discussed in further detail with reference to the figures.

As used herein, "substrate media" and "media" refer to a tangible medium, such as paper (e.g., a sheet of paper, a long web of paper, a ream of paper, etc.), transparencies, parchment, film, fabric, plastic, photo-finishing papers or other coated or non-coated substrates on which information or on an image can be printed, disposed or reproduced. While specific reference herein is made to a sheet or paper, it should be understood that any substrate media in the form of a sheet amounts to a reasonable equivalent thereto As used herein, "alternating current corona device" or "AC corona device" refers to a device that emits an electrostatic charge to a predetermined location, such as an electrostatic charge generator.

As used herein, the terms "process" and "process direction" refer to a process of moving, transporting and/or handling a substrate media. The process direction substantially coincides with a direction of a flow path P along which the substrate media is primarily moved within the media handling assembly. Such a flow path P is the flow from upstream to downstream. A "lateral direction" or "trans-process direction" are used interchangeably herein and refer to at least one of two directions that generally extend sideways relative to the process direction. From the reference of a sheet handled in the process path, an axis extending through the two opposed side edges of the sheet and extending perpendicular to the process direction is considered to extend along a lateral or trans-process direction.

As used herein, "volume resistivity" or "specific insulation resistance" refers to the electrical resistance between opposite faces of a 1-centimeter cube of insulating material and is expressed in ohm-centimeters or ohm-cm.

As used herein, "sheet resistance" refers to a measure of resistance of thin films that are nominally uniform in thickness. Sheet resistance is applicable to two-dimensional systems in which thin films are considered as two-dimensional entities. When the term sheet resistance is used, it is implied that the current flow is along the plane of the sheet, not perpendicular to it. Because the bulk resistance is multiplied with a dimensionless quantity to obtain sheet resistance, the units of sheet resistance are ohms or ohms per square (ohms/sq.), which is dimensionally equal to an ohm, but is exclusively used for sheet resistance.

As used herein, an "image" refers to visual representation, such as a picture, photograph, computer document including text, graphics, pictures, and/or photographs, and the like, that can be rendered by a display device and/or printed on media.

As used herein, a "location" refers to a spatial position with respect to reference point or area.

As used herein, a "media printing system" or "printing system" refers to a device, machine, apparatus, and the like, for forming images on substrate media using ink, toner, and the like, and a "multi-color printing system" refers to a printing system that uses more than one color (e.g., red, blue, green, black, cyan, magenta, yellow, clear, etc.) ink or toner to form an image on substrate media. A "printing system" can encompass any apparatus, such as a printer, digital copier, bookmaking machine, facsimile machine, multi-function machine, etc. which performs a print outputting function. Some examples of printing systems include Xerographic, Direct-to-Paper (e.g., Direct Marking), modular overprint press (MOP), ink jet, solid ink, as well as other printing systems.

Exemplary embodiments included are directed to a system for reducing electrostatic fields underneath print heads including; a set of print heads for ejecting ink onto a substrate media, a means of moving the media substrate past the print heads using a print zone transport (i.e., the portion of the media transport in the zone where the print heads are located), which includes an insulating or semi-conductive belt transport materials of specifiable electrical properties (e.g., belt resistivity), a conductive platen against which the print zone transport is held flat, an electrostatic charge generator for generating electrostatic charges for holding media against the print zone transport belt so that media is held flat, an electrostatic field reducer system. The electrostatic field reducer system is located upstream of the print heads and uses an alternating current corona device positioned above the media and at least 25 mm away from any conductive surface below the belt. The conductive platen supports the belt in the print zone and has non-conductive elements (e.g., preferably in the form of apertures, most preferably slots) in the area corresponding to the ink deposition area of the print head. The system and method significantly reduce the electrostatic field in the ink deposition area and consequently reduce print quality defects.

In one embodiment, the alternating current corona device includes a coronode and a power supply that operate in cycles to provide positive and negative charges. Examples of alternating current corona devices are disclosed in U.S. Pat. No. 3,760,229 to Silverberg and U.S. Pat. No. 5,839,024 to May et al., both of which are incorporated herein in their entirety. When the electrostatic field between the media and the media transport belt is neutralized (i.e., the electrostatic field is about zero), the charges stop accumulating on the media. The electrostatic field charges on the top surface of the media are neutralized but a charge can still remain on the bottom surface of the media.

Figure 3:
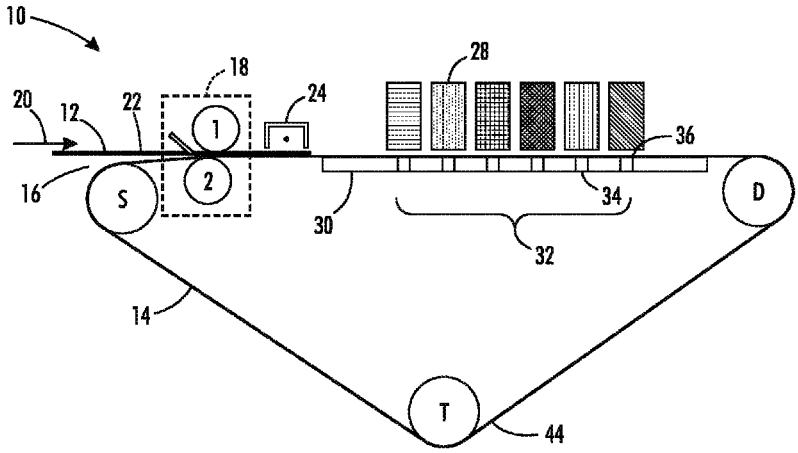
FIG. 3 depicts an embodiment of the ink jet printing system that uses electrostatic tacking to transport a media substrate past the print heads and an AC corona device to reduce the electrostatic field below the print heads.

The system 10 for reducing electrostatic fields is shown in FIG. 3. Media 12 (e.g., a sheet of paper) contacts the media transport belt 14 at a first end 16 and passes through an electrostatic tacking device 18, which creates an electrostatic field that holds the media 12 closely to the belt 14 as it moves in the process direction 20. In addition to holding the media 12 on the belt 14, the electrostatic field can affect the deposition of ink on the surface 22 of the media 12 by the inkjet print heads 28 and cause printing defects. Therefore, in order to neutralize the electrostatic field, an alternating current ("AC") corona device 24 is positioned between the electrostatic tacking device 18 and the print zone 32 (i.e., the location of the inkjet print heads 28). The AC corona device 24 neutralizes or substantially reduces the electric field on the surface 22 of the media 12 passing beneath it on the belt 14 by emitting positive and negative charges. To avoid grounding that would interfere with the operation of the AC corona device 24, any conductive materials below the belt 14 in the vicinity of the AC corona device 24 are located at a distance of at least 25 mm from the belt 14. The AC corona device 24 can be selected from several well known and commercially available devices that emit an electrostatic charge.

Figure 4:
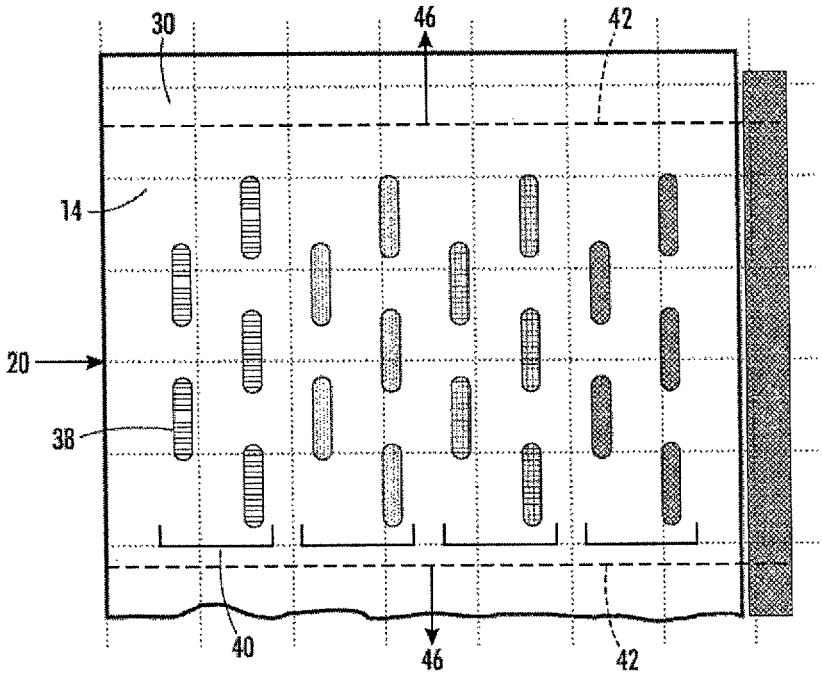
FIG. 4 depicts a top view of a conductive platen with a plurality of non-conductive areas formed by apertures that correspond to the locations of the ink deposition areas.

Although the field above the media 12 and belt 14 can be reduced to a very low value by the AC corona device 24 in the region around the corona device 24, it has been found that, when the media travels over the conductive platen 30 below the belt 14 near the print zone 32, the vicinity of a ground plane again produces an electrostatic field between the media 12 and the electrically grounded print head(s) 28. In order to reduce this field, the platen 30 has non-conductive areas 34 in registration with the ink deposition area 36. The non-conductive areas 34 may be slots in the conductive platen 30 as illustrated in FIGS. 3 and 4. Preferably the slots are tapered (larger spacing on the bottom than the top), or else the metal platen 30 layer is thin. If a thin metal platen 30 layer is used, it can be supported by a non-conductive structure below the top metal layer.

In an exemplary architecture shown in FIG. 4, the non-conductive areas 34 are apertures 38 in the platen 30, which are disposed in a staggered full width array ("SFWA"). The print heads 28 are opposite the apertures 38 and arranged in the same SFWA configuration. FIG. 4 is a top view showing the belt 14 supported by the platen 30 with the SWFA located underneath the ink deposition area 36 of the print heads 28. The process direction 20 is left to right and the plurality of apertures 38 corresponds to (and is in registration with) the ink deposition areas 36 of the print heads 28. A pair of columns 40 is dedicated to a set of multiple print heads 28 for each of the colors and the apertures 38 overlap to provide continuous printing in the process direction, as well as the trans-process direction. FIG. 4 shows eight columns of apertures 38 that can accommodate print heads 28 for inks of four different colors.

In FIG. 4, the apertures 38 in the platen 30 are rectangular with rounded corners that correspond to the ink deposition areas 36 of the different color print heads 28. The dashed lines 42 above and below the apertures 38 define the print zone 32. The print zone transport system 44 moves the media 12 on top of the transport belt 14 along a media path in a process direction 20 from left to right. As the media 12 passes under the print heads 28, the different inks are deposited onto the media 12 at locations that are in registration with the non-conductive areas 34 in the platen 30. The apertures 38 (also referred to herein as slots) have a width in the process direction 20 and a length in the trans-process direction 46. The length is preferably greater than the width and the width is at least 20 mm, preferably at least 25 mm and most preferably at least 30 mm.

EXAMPLES

Example 1

Figure 5:
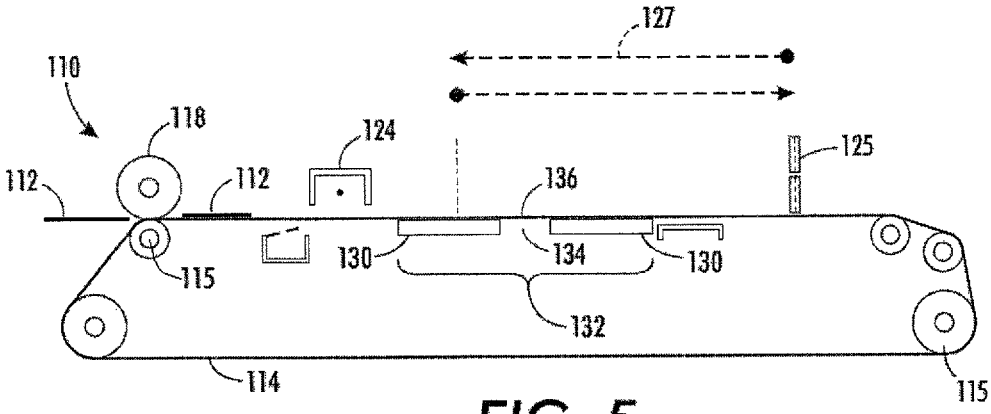
FIG. 5 depicts a model used for testing the electrostatic fields below the print heads for different sizes of slots in the platen.

FIG. 5 shows a belt module 110 that was used to measure the electrostatic field of the media 112 at the ink deposition area 136. For the purposes of the test, the results were interpreted based on the assumption that a standard print head with an 11 mm wide nozzle area was used. The belt module 110 includes an insulating belt 114 and rollers 115 that sequentially move the belt 114 under an electrostatic tacking station 118, an AC corona device 124 and the print zone 132 in a continuous loop. The two rollers 115 on either side of the top left portion of the belt denote the tacking station 118. Downstream of the tacking station 118 is the AC corona device 124 that is used to neutralize the electrostatic field. Below the belt 114, at a point corresponding to the print zone 132, are two conductive plates 130 (i.e., the simulated platen) that are spaced a predetermined distance apart to simulate an aperture or slot 134. The spacing for the slot 134 was varied by repositioning the conductive plates 130 in order to determine the dependency of the slot width on the electrostatic field. A scanning field probe 125 was passed back and forth 127 over the print zone 132 to measure the field as a function of position over the slot 134 for each of the seven (7) different slots widths (5, 8, 10, 15, 20, 25, 30 mm) that were tested. The field probe 125 used an electrically isolated metal section of known area surrounded by a grounded metal.

The field probe 125 works on the principal that the field E(x) above the surface of a conductor at any position x is proportional to the local charge density σ(x) (charge/area) on the conductor at that position x in accordance with Gausse's Law (i.e., $E=\sigma(x)/\in_0$, where $\in_0=8.85\times10^{-14}$ farad/cm). Thus, the field E(x) at the conductor can be determined by measuring the charge Q on a known area A of the conductor.

The charge on the isolated probe area was measured using a Keithley Model 610C Electrometer to determine the charge density at the conductive probe, which by Gauss's Law is proportional to the field below the conductor. As one skilled in the art would know, Gauss's Law, also known as Gauss's flux theorem, is a law relating the distribution of electric charge to the resulting electric field. Gauss's law states that the net flux of an electric field through a closed surface is proportional to the enclosed electric charge. It relates the electric fields at points on a closed surface (known as a "Gaussian surface") and the net charge enclosed by that surface. The electric flux is defined as the electric field passing through a given area multiplied by the area of the surface in a plane perpendicular to the field. The charges over the slot were measured using the scanning field probe 125 and electrostatic fields were calculated using a moving average and subtracting the calibration offset. A Keyence Sensor, which measures distance or proximity very accurately, was also used to determine if the paper was being held flat, indicating good electrostatic media tacking (electrostatic pressure) to the belt and platen.

Figure 6:
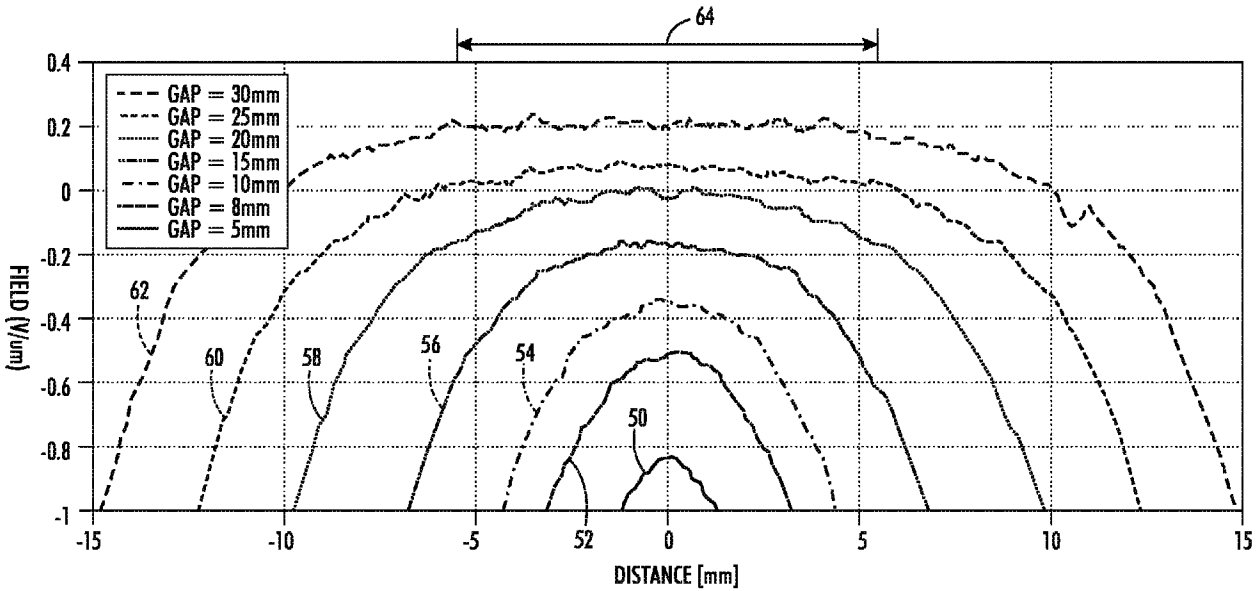
FIG. 6 is a graph that illustrates the variations in the electrostatic field as the size of the slots changes.

The results of the tests are shown in the graph in FIG. 6, which shows the curves for the electrostatic fields measured over the print zone 132. When the slot/gap between the two conductive plates is relatively small (5 mm and 8 mm, respectively), the curves 50, 52 show that the field underneath the print heads 28 (located at x=0 in FIG. 6) and field variations are significant. With slightly larger slots/gaps (10 mm, 15 mm, respectively), the curves 54, 56 show that the fields and the field variations decrease. With larger slots/gaps (20 mm, 25 mm, 30 mm, respectively), the curves 58, 60, 62 show that the fields (as measured in V/μm) are closer to zero and the field variations are much smaller, which have a beneficial effect on print quality. At the top of the graph, the width 64 of a standard 11 mm nozzle is shown.

Figure 7:
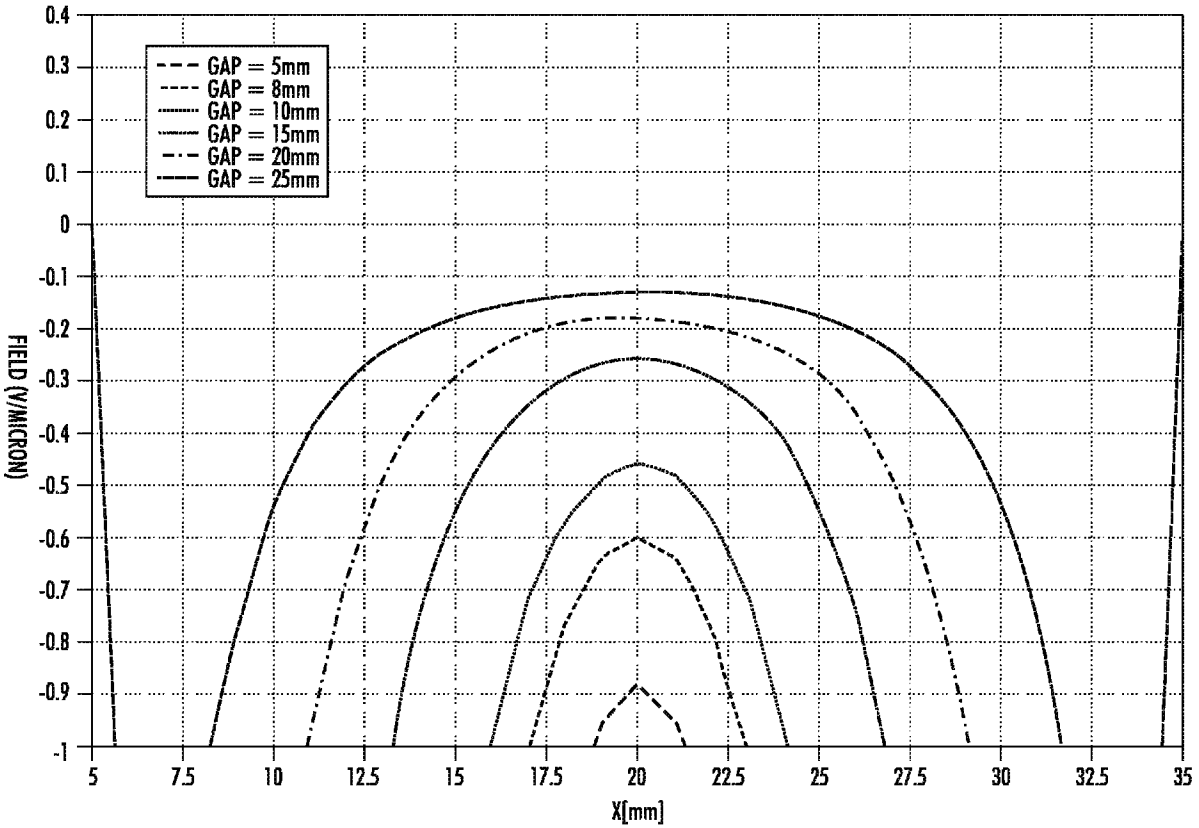
FIG. 7 is a graph for an electrostatic model that illustrates the variations in the shape of the curve for the electrostatic field as the size of the slots changes.

An electrostatic model was developed by applying Gauss's law for electric fields in dielectric materials, and the results for a configuration similar to FIG. 5 are shown in FIG. 7. FIG. 7 shows the calculated electric field on the surface of the media as a function of electrode gap. The electric properties of the paper and belt in the model were based on published or measured values. Model calculations shown in FIG. 7 are in good agreement with the experimental data shown in FIG. 6.

It will be appreciated that various embodiments of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A system for reducing electrostatic fields underneath print heads, the system comprising:

a plurality of print heads for depositing ink onto a surface of a media substrate in a plurality of ink deposition areas;

a media transport for moving the media substrate along a media path in a process direction past the plurality of print heads, wherein the media transport comprises a media transport belt, and wherein the media substrate has an electrostatic charge on the surface;

a conductive platen contacting the media transport belt, wherein the conductive platen has a plurality of apertures in a staggered full width array configuration across said platen, wherein each of the apertures has a length and a width, and wherein the width is at least 20 mm and extends in the process direction and the length is greater than the width; and an electrostatic field reducer comprising an alternating current corona device positioned upstream of the plurality of print heads in the process direction, wherein the electrostatic field reducer reduces the electrostatic charge on the surface of the media substrate, wherein said plurality of print heads are arrayed opposite from said apertures across said media transport belt, said plurality of print heads being in the same staggered full width array configuration as said apertures so as to be in registration therewith.

2. The system for reducing electrostatic fields underneath print heads according to claim 1, wherein the conductive platen is substantially flat.

3. The system for reducing electrostatic fields underneath print heads according to claim 1, wherein the apertures each having a width in the process direction and a length in the trans-process direction, and wherein the length is greater than the width.

4. The system for reducing electrostatic fields underneath print heads according to claim 1, wherein each of the plurality of print heads has a process dimension of an ink ejecting region, and wherein the apertures each have a dimension in the process direction of at least 180% of the process dimension.

5. The system for reducing electrostatic fields underneath print heads according to claim 1, wherein the media transport belt is formed from insulative or semi-conductive materials.

6. The system for reducing electrostatic fields underneath print heads according to claim 5, wherein the semi-conductive materials in the media transport belt are formed in layers and have a sheet surface resistivity greater than $10^{10}$ ohms/sq.

7. The system for reducing electrostatic fields underneath print heads according to claim 1, wherein the alternating current corona device is an electrostatic charge generator, and wherein the AC voltage is in a range of from 2-10 kV at 200 to 1000 Hz.

8. The system for reducing electrostatic fields underneath print heads according to claim 1, wherein the alternating current corona device has an AC voltage of about 5 kV at about 600 Hz.

9. The system for reducing electrostatic fields underneath print heads according to claim 1, wherein the location of the alternating current corona device discharge onto the surface of the media substrate is at least 25 mm from any conductive surface below the belt.

10. The system for reducing electrostatic fields underneath print heads according to claim 1 further comprising an electrostatic charge generator located upstream of the electrostatic field reducer for generating the electrostatic charge on the surface of the media substrate, wherein the electrostatic charge form the electrostatic field and the media substrate is held against the media transport belt by the electrostatic field.

11. The system for reducing electrostatic fields underneath print heads according to claim 1, wherein the electrostatic field reducer reduces the electrostatic field on the surface of the media substrate receiving the ink to less than 0.2 V/micron.

12. The system for reducing electrostatic fields underneath print heads according to claim 1, wherein the electrostatic field reducer reduces the electrostatic field on the surface of the media substrate receiving the ink to about zero.

13. A system for reducing electrostatic fields underneath print heads, the system comprising:

a plurality of print heads for depositing ink onto a surface of a media substrate in a plurality of ink deposition areas;

a media transport for moving the media substrate along a media path in a process direction past the plurality of print heads, wherein the media transport comprises a media transport belt, and wherein the media substrate has an electrostatic charge on the surface;

a conductive platen contacting the media transport belt, wherein the conductive platen has a plurality of apertures in a staggered full width array configuration across said platen, wherein each of the apertures has a length and a width, and wherein the width is at least 20 mm and extends in the process direction and the length is greater than the width; and an electrostatic field reducer comprising an alternating current corona device positioned upstream of the plurality of print heads in the process direction, wherein the location of the alternating current corona device discharge on the surface of the media substrate is at least 25 mm from any conductive surface below the belt, wherein the electrostatic field reducer reduces the electrostatic field to about zero on the surface of the media receiving the ink, and wherein said plurality of print heads are arrayed opposite from said apertures across said media transport belt, said plurality of print heads being in the same staggered full width array configuration as said apertures so as to be in registration therewith.

* * * * *